United States Patent [19]

Gordon

[11] 4,129,629

[45] Dec. 12, 1978

[54] PROCESS FOR MAKING HYDROPHILIC POLYOLEFIN FIBERS CONTAINING CLAY

[75] Inventor: Wolfgang Gordon, Hofheim, Fed. Rep. of Germany

[73] Assignee: Hoechst Aktiengesellschaft, Frankfurt am Main, Fed. Rep. of Germany

[21] Appl. No.: 635,745

[22] Filed: Nov. 26, 1975

[30] Foreign Application Priority Data

Nov. 28, 1974 [DE] Fed. Rep. of Germany ..... 2456277

[51] Int. Cl.[2] ..... C08J 3/20; B29C 6/00

[52] U.S. Cl. ..... 264/13; 260/42.45; 260/42.55; 264/211

[58] Field of Search ..... 260/42.16, 42.57, 42.19, 260/42.37, 42.55, 42.44, 42.54, 42.45, 29.6 XA; 264/204, 211, 13

[56] References Cited

U.S. PATENT DOCUMENTS

| | | | |
|---|---|---|---|
| 3,554,683 | 1/1971 | Fujisake et al. | 260/42.19 |
| 3,674,736 | 7/1972 | Lerman et al. | 260/41 R |
| 3,790,521 | 2/1974 | McCann et al. | 260/29.6 XA |
| 3,803,065 | 4/1974 | Arai et al. | 260/42.16 |
| 3,808,091 | 4/1974 | Aoki et al. | 162/157 R |
| 3,885,014 | 5/1975 | Fukada et al. | 264/176 F |
| 3,914,354 | 10/1975 | Ueki et al. | 264/13 |
| 3,928,504 | 12/1975 | Koelewign | 204/78 |
| 4,001,035 | 1/1977 | Ito et al. | 260/42.44 |
| 4,013,617 | 3/1977 | Gordon et al. | 260/42.55 |

*Primary Examiner*—Jay H. Woo

*Attorney, Agent, or Firm*—Curtis, Morris & Safford

[57] ABSTRACT

Hydrophilic polyolefin fibers containing more than 50% by weight of clay are obtained by passing a mixture, which is kept under pressure and consists of a polyolefin, a solvent for the said polyolefin, clay, a hydrophilization agent, water and an amine, through a nozzle into a zone of low pressure. The fibers obtained can be used, with small expenditure for working up, for the manufacture of synthetic paper.

10 Claims, 1 Drawing Figure

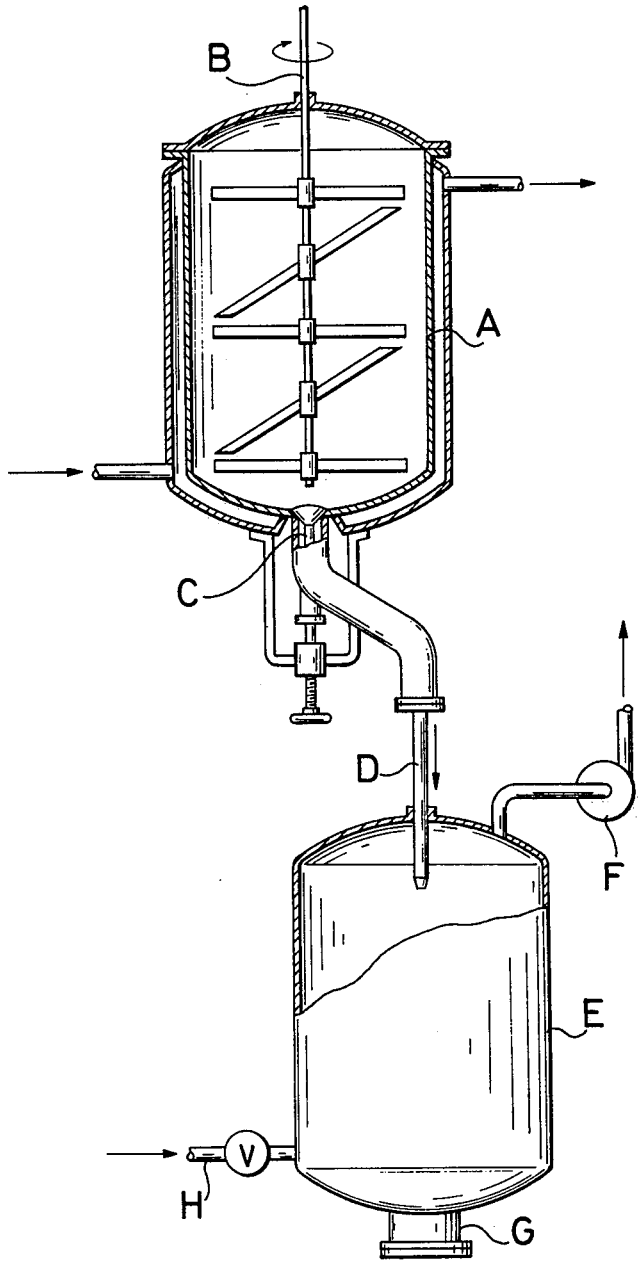
B
A
C
D
F
E
V
H
G

PROCESS FOR MAKING HYDROPHILIC POLYOLEFIN FIBERS CONTAINING CLAY

This invention relates to a process for making hydrophilic polyolefin fibers containing clay.

It has been known for some time to produce polyolefin fibers containing pigments (cf. Published German Application DAS No. 1,292,301). "Small amounts" of pigments and other insoluble compounds are added to a superheated polymer solution kept under pressure and fibers are formed by flash evaporation of the solution into a zone of low pressure. If, however, this process is used for polyolefins the fibers obtained are hydrophobic and not hydrophilic, which greatly restricts their technical applications. Moreover, the patent specification referred to does not disclose any particulars about making fibers with more than "small amounts" of pigment. It can be assumed that the expression "small amounts" means less than 20%, calculated on the total weight of the fibers.

It has also been proposed to add up to 50% by weight, calculated on the fiber weight, of insoluble fillers (cf. Published German Application DOS No. 2,252,759). This process yields hydrophobic fibers as well. In the specification nothing is said about the special difficulties in the manufacture of polyolefin fibers with high filler content as described below.

Still further, it is known to prepare polymer fibers by flash evaporation of an emulsion of a polymer solution and an aqueous solution of a wetting agent to which pigments may be added (cf. published German Application DAS No. 2,121,512). This latter specification is also silent with respect to the special difficulties of the measure and its control.

It is not yet known how to prepare hydrophilic polyolefin fibers containing clay which do not have the disadvantages described below. The aforesaid publications neither disclose hydrophilic polyolefin fibers containing more than 20% by weight of clay nor describe polyolefin fibers containing more than 50% by weight of clay.

There has also been proposed a process for the manufacture of hydrophilic polyolefin fibers containing clay (cf. Published German Application DOS No. 2,424,291) using hydrophobized aluminum silicate. This process requires the known and expensive hydrophobization of the pigment.

The present invention provides a process for the manufacture of hydrophilic polyolefin fibers containing clay by flash evaporation of a suspension of clay, which is superheated and kept at least under autogeneous pressure, in an emulsion of a solution of a polyolefin in a readily boiling solvent for the said polyolefin and an aqueous solution of a hydrophilization agent through a nozzle into a zone of reduced pressure, which comprises using a suspension containing an organic amine dissolved therein.

Suitable polyolefins are polyethylenes of high and low molecular weight having a reduced specific viscosity of from 0.3 to 20 dl/g, preferably 0.7 to 10 dl/g, determined according to H. Wesslau as described in Kunststoffe 49, page 230 (1959).

The polyethylene may contain small amounts of comonomers having 3 to 6 carbon atoms in an amount such that the polymer has a density of from 0.93 to 0.97 g/cc, preferably 0.94 to 0.965 g/cc.

Further suitable polyolefins are homo- and copolymers of propylene, preferably containing an atactic portion of 0 to 25%, the best results being obtained with an atactic portion of from 0 to 6%. As copolymers of propylene there are preferred random copolymers with 0.1 to 3% by weight of ethylene or with 0.1 to 2% by weight of butylene. Block copolymers with ethylene and random copolymers with higher content of comonomer can also be used.

As hydrophilization agents all known types of emulsifiers can be used, preferably, however, polymeric hydrophilization agents containing amine groups, amide groups, carboxyl groups and/or hydroxyl groups. Very good results are obtained with polyvinyl alcohol having a viscosity of from 4 to 70 cp in a 4% solution in water and a degree of saponification of from 80 to 99.5%. The hydrophilization agent should confer a good dispersibility in water upon the polyolefin fibers filled with clay, that is the fibers should acquire good wetting properties and become readily and uniformly dispersible in water.

The solvent used for the polyolefin should have a sufficiently low boiling point so that satisfactory superheating and flash evaporation are possible and its critical temperature should be sufficiently high. Therefore, in the process of the invention there are suitable hydrocarbons having from 5 to 7 carbon atoms, preferably cyclic or acyclic saturated hydrocarbons having 5 or 6 carbon atoms. Good results can also be obtained with chlorinated hydrocarbons having 1 or 2 carbon atoms, preferably methylene chloride.

The temperature of the suspension can vary in the range of from 110° to 200° C., a temperature range of from 120° to 160° C. being especially suitable from an industrial point of view. The hot suspension is kept under the autogeneous pressure of the water/solvent mixture which can be increased by using an inert gas and/or with the aid of a pump.

The clay should be suspended as uniform as possible in the emulsion formed by a solution of a polyolefin in a low boiling solvent and an aqueous solution of a hydrophilization agent. This can be achieved with discontinuous and continuous operation by preparing the suspension in commercial suspension and emulsion devices with good mass circulation and sufficient shearing effect. The advantages of the process of the invention are exhibited with water-in-oil emulsions as well as with oil-in-water emulsions.

For flash evaporation the suspension is passed through a nozzle the shape of which is not critical. It serves in the first place to maintain a pressure difference between suspension and flash chamber. The pressure in the flash chamber is chosen in such a manner that over 90% of the solvent for the polymer evaporates. Simultaneously, part of the water also evaporates. Hence, the pressure is in the range of from 10 to 1,500 torrs, preferably 50 to 800 torrs. The pigment-containing fibers obtained are moist with water and can be comminuted and separated from the water in commercial devices.

Clay is an inorganic material containing as main constituent a compound of the formula $Al_2O_3.2SiO_2.2H_2O$. It is obtained by mining, purified by known processes and ground. In the process of the invention it is used in the ground form without having been subjected to a hydrophobization process. The type of the impurities still contained in the clay and their amount does not have a detrimental effect on the process of the invention. The particle size of the clay used can vary within wide limits. In most cases 90% of the particles will have a diameter of less than 50 microns, preferably less than 10 microns.

The chemical structure of the amines used in the process of the invention can be very different. Suitable organic radicals of the amines are aliphatic, aromatic, or alkylaromatic radicals having from 4 to 30 carbon atoms, preferably 6 to 20 carbon atoms. The organic radicals may be acyclic, monocylic or bicyclic, the nitrogen may be a member of the ring or it may be outside of the ring. Although primary as well as secondary and tertiary amines can be used, best results are obtained with primary amines which are preferred. The number of amino groups and the position of the amino groups to one another is of minor importance only to the advantages of the present process. In most cases mono- or di-amines are used, the former being preferred. Besides the amino groups the organic amines used may contain further functional groups and hetero atoms, but the advantages of the process of the invention diminish with increasing polarity of the said functional groups and hetero atoms. The amines can be used singly or in admixture with one another, preferably however in the form of mixtures as obtained in industrial processes, for example amines with alkyl radicals of different chain length and/or amines with different degree of alkylation at the nitrogen atom. Preferred amines are, for example, n-hexylamine-1, cyclohexylamine, 1,6-hexamethylenediamine, bisaminomethyl-norbornane, aniline, p-toluidine, p-chloroaniline, benzylamine, 2-ethylhexylamine-1, n-decylamine-1, n-dodecylamine-1, N,N-methyldodecylamine-1, N,N,N-dimethyldodecylamine-1, 1,12-dodecamethylenediamine, oleylamine-1, octadecylamine-1, and N,N-dioctadecylamine-1.

The amount of organic amine used is relatively small, it depends to a limited extent on its chemical structure. In general 0.05 to 5% by weight of amine are used for one part by weight of clay. A range of from 0.1 to 1% by weight of amine per part by weight of clay is preferred.

The concentration of the amine in the suspension varies from 0.01 to 10 g/l, depending on the desired pigment content in the fibers and the type and amount of hydrophilization agent. The residence time of the amine in the emulsion is mostly 10 seconds or more, preferably more than 2 minutes. Extremely long residence times do not alter the effect of the amine.

The mode of preparation of the amine-containing suspension of clay in an emulsion of a solution of a polyolefin in a low boiling solvent and an aqueous solution of a hydrophilization agent is not critical. The amine may be added to the suspension in the form of a pure liquid or as a solution in the solvent for the polymer, either continuously or discontinuously, or any other known method can be used for making the amine-containing suspension. The dissolved or liquid amine can be added, for example to the polyolefin solution and the pigment can then be suspended in the mixture obtained, whereupon the suspension is emulsified with the aqueous solution of the hydrophilization agent. Alternatively, a solution of polyolefin and amine can be mixed with emulsification with an aqueous suspension of clay and an aqueous solution of the hydrophilization agent.

According to a preferred discontinuous mode of operation the polyolefin, pigment, amine in pure form and the hydrophilization agent in pure or dissolved form, as well as water and solvent for the polymer are introduced in any order of succession into a cold autoclave and the suspension is prepared by heating all components while stirring with an efficient stirrer.

According to a preferred continuous mode of operation the main quantity of pigment is suspended in a solution of the amine in the solvent for the polyolefin, the suspension obtained is used to dilute a concentrated polyolefin solution, or a concentrated polyolefin suspension, and the mixture is heated to dissolve the polyolefin. The suspension of clay in a solution of polyolefin and amine is then mixed with emulsification with an aqueous solution of the hydrophilization agent and an aqueous suspension of a comparatively small amount of pigment which is recycled after comminution of the fibers and mechanical partial removal of water therefrom.

In all modes of operation an isolation of hydrophobized clay requiring an expensive step of drying is dispensed with. It is the surprising result of the experiments that have been carried out and a special advantage of the present process that such an isolation is not necessary.

When the process of the invention is carried out without the addition of organic amines considerable technical difficulties are encountered. Our experiments have shown that only part of the hydrophilic pigment is incorporated into the fibers, i.e. enclosed in a polyolefin skin. About 40 to 60% of the hydrophilic pigment remains in its original powder form and is washed off with the water in the partial mechanical dehydration of the fibers. To avoid losses, rather expensive devices for separating and recycling considerable amounts of clay are required. A further portion of the pigment adheres only loosely to the fibers. When the fibers are comminuted in commercial devices the adhering pigment is detached from the fibers and lost, or it must be recycled. Moreover, the distribution of the pigment in the fiber is not uniform and a relatively large amount of short fibers with high pigment content are obtained. When the fibers are used in paper manufacture said short fibers pass through the sieve and pollute the waste water whereby water disposal problems arise unless the portion of short fibers is recovered.

It is surprising that in the process of the invention the aforesaid problems practically do not arise. The clay which is not previously hydrophobized is uniformly and almost completely incorporated into the polyolefin fibers. Thus, the losses in flash evaporation, fiber comminution or in paper manufacturing are small. The advantages gain in importance with increasing pigment concentration in the fibers. At a pigment content above 30% the differences are so distinct that an operation in the absence of an amine involves considerable disadvantages. The process of the invention permits for the first time the production of clay-containing hydrophilic fibers from polyolefins having a pigment content of more than 50% by weight, calculated on the fiber weight, with the use of non-hydrophobized clay.

A further advantage of the process of the invention resides in the fact that at pigment contents of 50% and thereabove, calculated on the total weight of polyolefin and pigment, very uniform and short fibers are obtained by flash evaporation so that in most cases a further comminution of the fibers or a homogenization of the fiber length is not necessary. This effect cannot be obtained with known means in the absence of pigments even with very low polymer concentrations.

Hydrophilic polyolefin fibers having a pigment content of from 50 to 90% can be used a fillers in all non wovens. As compared to clay which is not in fiber shape they exhibit a better retention in the manufacture of the non woven and compared to hydrophilic polyolefin fibers without clay they have a higher covering capacity in a non woven fabric.

A calendered paper containing the fibers according to the invention is more opaque than a calendered paper containing known polyolefin fibers. The hydrophilic character of the pigment containing fibers is necessary for processing the fibers from an aqueous suspension, for example in the paper industry.

The following examples illustrate the invention.

EXAMPLE 1 WITH COMPARISON

To prepare the fibers according to the invention a device as diagrammatically shown by way of example in the accompanying drawing was used.

In an autoclave A having a volume of 70 liters and equipped with a five-blade-multistage-impulse-countercurrent stirrer B 0.6 kg of polyethylene having a density of 0.960 g/cc, a reduced specific viscosity of 1.4 dl/g and a molecular weight distribution $M_w/M_n$ of 6, 20 l of hexane, 15 l of water, an aqueous solution of 40 g polyvinyl alcohol having a viscosity of 4 cp in a 4% aqueous solution at 20° C. and a degree of saponification of 98%, 2.4 kg of China clay from England, 90% of which had a particle size of less than 10 microns and the analysis of which indicated a content of 46.2% $SiO_2$, 38.7% of $Al_2O_3$ and an ignition loss of 13.1%, and 12 g of industrial grade dodecylamine-1 were dissolved, emulsified and suspended in one another at a temperature of 140° C. and with a stirrer speed of 600 rotations per minute. The total pressure in the autoclave was adjusted to 16 kg/cm$^2$ by means of nitrogen. After opening bottom valve C the emulsion passed through tube shaped nozzle D having an internal diameter of 4 mm and a length of 1.20 m into a vessel E in which a vacuum of about 100 torrs was produced by vacuum pump F. The fibers formed were collected in said vessel and the residual amount of hexane remaining in the fibers was expelled under reduced pressure by introducing steam through steam pipe H. The water-containing fibers were discharged through outlet G capable of being closed.

After partial removal of water by mechanical compression to a fiber content of about 30%, the fibers obtained contained 75.0% of the pigment used, i.e. in the flash evaporation of the suspension 94.0% of the pigment was retained in the fibers. The fibers obtained had a hydrophilic character and could be easily dispersed in water. When 2 g of the fibers were uniformly dispersed in 800 ml of water in a 1 liter measuring cylinder by repeatedly shaking and the fiber suspension was allowed to stand for 2 minutes the fibers settled to a small extent so that after that time the supernatant fiber-free water occupied a volume of 55 ml.

2 Grams of the fibers obtained were classified in a diaphragm classifier according to Brecht-Holl for 10 minutes for each sieve under a water pressure of 0.5 atmosphere gauge with maximum lift. 26% of the fibers remained on the sieve with a mesh width of 0.40 mm, 61% remained on the sieve with 0.12 mm mesh width while 13% passed this latter sieve. This result showed that the fibers were uniform and short and that they could be used without further comminution for the manufacture of paper.

When a paper sheet having a weight of 160 g/m$^2$ was prepared from the fibers on a Rapid-Köthen-Sheet-Former the sheet had a content of pigment of 72.9%, i.e. the pigment retention in the fiber processing amounted to 98.5%. Attempts to make a paper sheet from 75% of hydrophilic pigment and 25% of comparable polyethylene fibers free from pigment resulted in a pigment retention of 19% only. The overall retention of clay in all steps together, i.e. fiber formation and fiber processing, was 91.2%.

For comparsion fibers were prepared in the same manner but without addition of dodecylamine-1.

After partial water removal by mechanical compression to about 30% fiber content the fibers contained 38% of clay. When the fibers were classified as described above, 87% remained on the sieve with a mesh width of 0.40 mm, 11% on the sieve with a mesh width of 0.12 mm and 2% of the fibers passed the latter sieve. Although the fibers had good hydrophilic properties, they were not freely dispersible in dilute suspension and got entangled with one another.

Fibers the lengths of which could be compared to those of the fibers of the invention were obtaind only after two comminutions in a 12inch disc refiner of Messrs. Sprout-Waldron in known manner. A classification of the comminuted fibers then gave the following result: 19% remained on the 0.40 mm sieve, 62% were retained by the 0.12 mm sieve and 19% passed the latter sieve.

After partial mechanical water removal as above the clay content was found to be 28%, corresponding to a pigment retention in the preparation of the fibers of 35%.

When a paper sheet having a weight of 160 g/m$^2$ was prepared from the comminuted fibers on a Rapid-Köthen-Sheet-Former, the sheet had a pigment content of 20.5% only, that is to say the pigment retention from the fiber production to fiber processing was only 25.6%. It appears to be impossible to obtain in this manner hydrophilic fibers having a pigment content above 50%. The amounts of clay not retained in the fibers have to be recovered in complicated and expensive manner and recycled.

EXAMPLE 2 WITH COMPARISON

Under the conditions specified in Example 1, 0.6 kg of a polyethylene having a reduced specific viscosity of 3.4 dl/g and $M_w/M_n$ of 6, the density of which had been adjusted to a value of 0.945 g/cc by statistical copolymerization of ethylene with butene, 20 l of cyclohexane, 10 l of water, a solution of 50 g polyvinyl alcohol in water, 0.4 kg of clay (as used in Example 1) and 6 g cyclohexylamine were emulsified and suspended and fibers were prepared by flash evaporation. The fibers were comminuted in a disk refiner in three stages.

In a parallel test no cyclohexylamine was used and the fibers obtained were comminuted under identical conditions in four stages. The distribution of the fiber length, determined as described in Example 1, the pigment contents after flash evaporation, after comminution and after sheet formation are indicated in Table 1.

TABLE 1

| Pigment (content in % calculated on total weight of clay and polyethylene) | without amine | with amine |
|---|---|---|
| clay used | 40 | 40 |
| clay after flash evaporation | 18 | 34.5 |
| clay after comminution | 14 | 32 |
| clay in sheet | 11 | 28.5 |

TABLE 1-continued

| Pigment (content in % calculated on total weight of clay and polyethylene) | without amine | with amine |
|---|---|---|
| % on 0.40 mm sieve | 20 | 24 |
| % on 0.12 mm sieve | 56 | 60 |
| % through 0.12 mm sieve | 24 | 16 |

EXAMPLE 3 WITH COMPARISON

Polypropylene fibers were obtained by emulsification and suspension of 1.0 kg polypropylene having a reduced specific viscosity of 2.3 gl/g and 3.3% of fractions soluble in heptane (12 hrs in Soxhlet), 20 l of isopentane, 20 l of water, an aqueous solution of 60 g of polyvinyl alcohol having a viscosity of 66 cp in a 4% aqueous solution at 20° C. and a degree of saponification of 99%, 1.0 kg of pigment as specified in Example 1 and 2 g of 1,12-dodecane-methylenediamine with subsequent flash evaporation as described in Example 1 but under a pressure of 25 kg/cm$^2$ above the suspension and 250 torrs in the flash zone, which fibers were comminuted in one stage in a disk refiner. In a comparitive experiment without 1,12-dodecane-methylenediamine the fibers obtained after flash evaporation were comminuted in two stages. The pigment contents and the classification results of the fibers are indicated in the following Table 2.

TABLE 2

| Pigment (content in % calculated on total weight of clay and polypropylene) | without amine | with amine |
|---|---|---|
| clay used | 50 | 50 |
| clay after flash evaporation | 24 | 47 |
| clay after comminution | 19 | 44 |
| clay in sheet | 16 | 41 |
| % on 0.40 mm sieve | 13 | 18 |
| % on 0.12 mm sieve | 64 | 48 |
| % on through 0.12 mm sieve | 23 | 34 |

What is claimed is:

1. A process for making hydrophilic clay-containing polyolefin fibers which comprises preparing a suspension of non-pre-hydrophobized clay particles in an emulsion of (a) a solution of a polyolefin in a volatile organic solvent and (b) an aqueous solution of a hydrophilizing agent, said emulsion containing from 0.05 to 5% by weight, based on the weight of clay, of an amine selected from aliphatic, aromatic and alkylaromatic amines having from 4 to 30 carbon atoms, said amine constituting 0.01 to 10 grams per liter of said suspension and the residence time of said amine in said emulsion being at least 10 seconds, superheating said suspension under at least an autogenous pressure and flowing said suspension through a restricted passage to a relatively low pressure zone to cause flash evaporation of said solvent and form said hydrophilic clay-filled polyolefin fibers.

2. The process of claim 1, wherein the organic amine is added to the suspension in liquid form or in the form of a solution.

3. The process of claim 1, wherein the polyolefin is a polyethylene having a density of from 0.93 to 0.97 g/cc.

4. The process of claim 1, wherein the polyolefin is a polypropylene having an atactic proportion of 0–25%.

5. The process of claim 1, wherein polyvinyl alcohol is used as hydrophilizing agent.

6. The process of claim 1, wherein a saturated $C_5$ or $C_6$ hydrocarbon or methylene chloride is used as solvent for the polyolefin.

7. The process of claim 1, wherein, prior to flash evaporation, the suspension has a temperature of from 110° C. to 200° C.

8. The process of claim 1, wherein a pressure from 10 to 1,500 torrs prevails in the zone of low pressure.

9. The process of claim 1, wherein 90% by weight of the clay has a particle size below 50 microns.

10. The process of claim 1, wherein the organic amine is used in an amount of from 0.1 to 1% by weight for each part by weight of clay.

* * * * *